US005697298A

United States Patent [19]

Greive et al.

[11] Patent Number: 5,697,298

[45] Date of Patent: Dec. 16, 1997

[54] SHEET GUIDE IN A FEEDER OF A SHEET-FED PRINTING PRESS

[75] Inventors: Martin Greive, Heidelberg; Volker Bergen, Wiesloch, both of Germany

[73] Assignee: Heidelberger Druckmaschinen AG, Heidelberg, Germany

[21] Appl. No.: 522,736

[22] Filed: Sep. 1, 1995

[30] Foreign Application Priority Data

Sep. 3, 1994 [DE] Germany ..... 44 31 488.4

[51] Int. Cl.[6] ..... B65H 9/12

[52] U.S. Cl. ..... 101/232; 271/241; 267/158; 400/579

[58] Field of Search ..... 101/232; 400/579, 400/624, 625, 630, 642; 271/241; 267/260, 158

[56] References Cited

U.S. PATENT DOCUMENTS 3,908,980 9/1975 Fowler ..... 271/3

5,328,167 7/1994 Frank ..... 271/241

FOREIGN PATENT DOCUMENTS 29 39 267 A1 4/1981 Germany .

*Primary Examiner*—Edgar S. Burr

*Assistant Examiner*—David Ghatt

*Attorney, Agent, or Firm*—Herbert L. Lerner; Laurence A. Greenberg

[57] ABSTRACT

A sheet guide in a feeder of a sheet-fed printing press has lateral guide plates for upper sheets of a sheet pile for laterally aligning the upper sheets with one sheet edge, and at least one deformable leaf spring located at a side of the sheet pile opposite to the side thereof at which the aligned sheet edge is disposed and acting by spring force against the upper sheets transversely to a sheet-feeding direction of the upper sheets of the sheet pile, the leaf spring being re-deformable counter to the spring force to behind a surface of the guide plate.

6 Claims, 3 Drawing Sheets

SHEET GUIDE IN A FEEDER OF A SHEET-FED PRINTING PRESS

BACKGROUND OF THE INVENTION

Field of the Invention

The invention relates to a sheet-guide or guiding system in a feeder of a sheet-fed printing press, preferably a sheet-fed rotary offset printing press.

For the desired true-to-register transport of the respective uppermost sheet of a sheet pile in the feeder, a correspondingly precise guidance, transversely to the direction of feeding, of the upper sheet, which has been fanned by lateral blast air, is required. For this purpose, lateral guide plates are provided which are adjustable to the width or breadth of of the format or size of sheet to be printed and guide the sheet pile in the upper region thereof. The guide plates effect a narrowing of the sheet guidance for laterally aligning a sheet edge of the respective uppermost sheet, in order thereby to afford the prerequisites for a true-to-register sheet transport.

SUMMARY OF THE INVENTION

It is accordingly an object of the invention to provide a sheet guide in a feeder of a sheet-fed printing press wherein this lateral alignment is improved independently of the character of the paper to be printed and of the size or format of the sheets thereof, especially for high-speed sheet-fed printing presses, and the means necessary in this regard for adjusting to alternating requirements are formed so as to be quickly changeable.

With the foregoing and other objects in view, there is provided, in accordance with the invention, in a feeder of a sheet-fed printing press, a sheet guide comprising lateral guide plates for upper sheets of a sheet pile for laterally aligning the upper sheets with one sheet edge, and at least one deformable leaf spring located at a side of the sheet pile opposite to the side thereof at which the aligned sheet edge is disposed and acting by spring force against the upper sheets transversely to a sheet-feeding direction of the upper sheets of the sheet pile, the leaf spring being re-deformable counter to the spring force to behind a surface of the guide plate.

In accordance with another feature of the invention, the leaf spring extends from below and from the outside in an inclined upward and inward direction and is fastened at a lower end thereof.

In accordance with a further feature of the invention, the leaf spring at the lower fastening end thereof is formed with a clamping nose slidable with spring bias on a lower end of the guide plate.

In accordance with an added feature of the invention, the fastening end of the leaf spring has a U-shaped construction, and the clamping nose engages in a catch disposed on the guide plate.

In accordance with an additional feature of the invention, the leaf spring is disposed so as to be adjustable in a sheet-feeding direction of the uppermost sheet of the sheet pile.

In accordance with yet another feature of the invention, the sheet guide includes a plurality of the leaf springs disposed adjacent one another at one side of the sheet pile in a sheet-feeding direction of the uppermost sheet of the sheet pile.

In accordance with a concomitant feature of the invention, the sheet guide includes a plurality of the leaf springs having varying spring tension, the leaf springs, respectively, being exchangeable for one another.

The thus provided leaf spring effects an optimum narrowing or constriction of the respectively uppermost sheet and the precise feeding thereof with the alignment edge thereof at side marks or the like in the feeder, before the sheet is transported in the feeding direction. Due to the leaf spring, lateral forces for aligning are applied to the sheet with slight spring tension, and the sheet is thereby set in position with the aligning edge thereof. The spring tension is selected in accordance with the quality of the paper to be printed and the the quality of any other material to be printed, respectively. The fastening of the leaf spring is effected preferably at the lower end thereof, so that it extends at an inclination from below and the outside to above and towards the inside to the middle of the printing press and is thereby effective only against the upper sheets, respectively, of the sheet pile, which are fanned by lateral blast air.

In accordance with the invention, as aforenoted, the leaf spring is formed with a clamping nose at a lower fastening end thereof, the clamping nose being slidable with spring tension onto the lower end of the guide plate, so that a relatively easy exchange or replacement of the leaf spring is possible. An adjustment of the spring tension to the characteristics or properties of the quality of the paper or the like to be printed can thereby be performed without tools and minimal manipulations. The clamping nose is located on a preferably U-shaped, pocket-type construction of the fastening end of the leaf spring, and engages in a catch formed on the guide plate, in order to ensure a reliable hold. A changing of the leaf spring or an adjustable arrangement in the sheet-feeding direction can be provided for adjusting to varying sheet sizes or formats. It is also possible to arrange several leaf springs adjacent one another on one side of the sheet pile in the direction of sheet feeding, so as to achieve thereby an effectiveness thereof for both minimum and maximum sheet sizes or formats.

Other features which are considered as characteristic for the invention are set forth in the appended claims.

Although the invention is illustrated and described herein as embodied in a sheet guide in a feeder of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
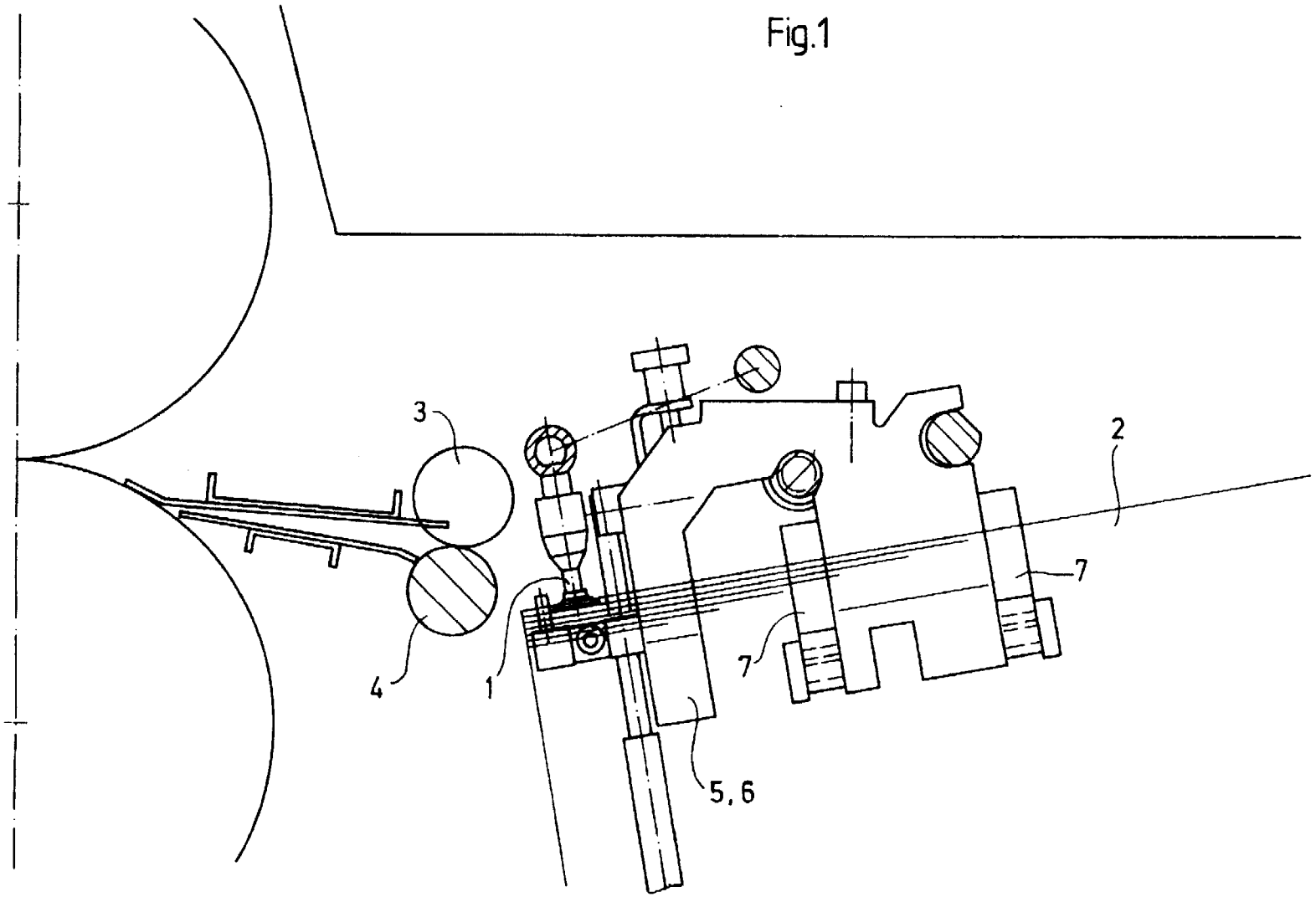
FIG. 1 is a diagrammatic side elevational view of a feeder of a sheet-fed printing press incorporating the sheet guide according to the invention.

Referring now to the drawings and, particularly, to FIG. 1 thereof, there is shown therein a single-sheet feeder. A lifting sucker 1 movable on a horizontally and vertically expanding loop lifts the respectively uppermost sheet of a sheet pile 2 and guides it by the leading edge thereof into a nip between two transport rollers 3 and 4 which assume the sheet transport to a non-illustrated printing unit of the printing press. The respective upper sheets of the sheet pile 2 are fanned upwardly by having blast air blown thereunder for the purpose of separating or singling the sheets.

Figure 2:
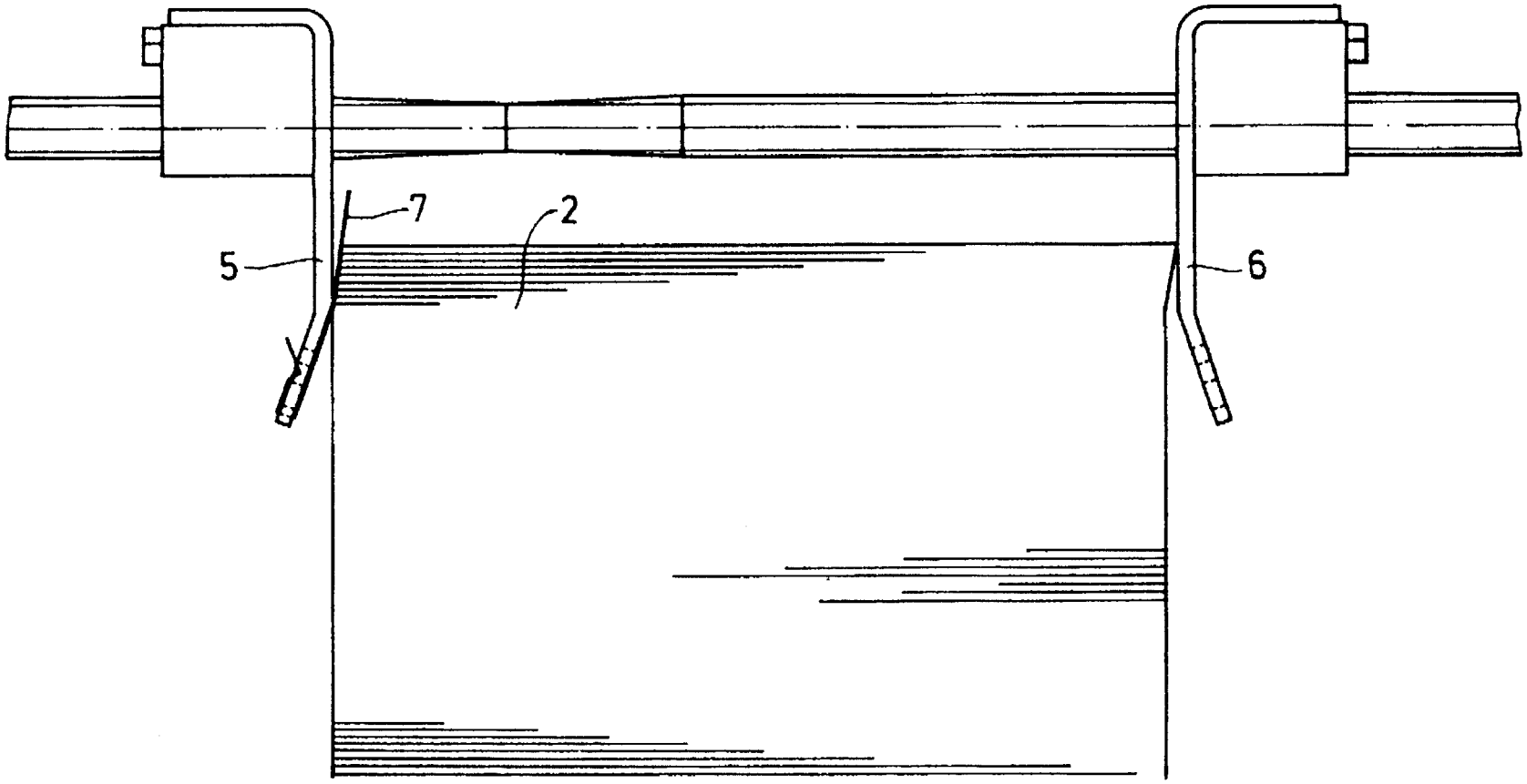
FIG. 2 is a front elevational view of FIG. 1 as seen from the right-hand side of the latter in the sheet-feeding direction.
Figure 3:
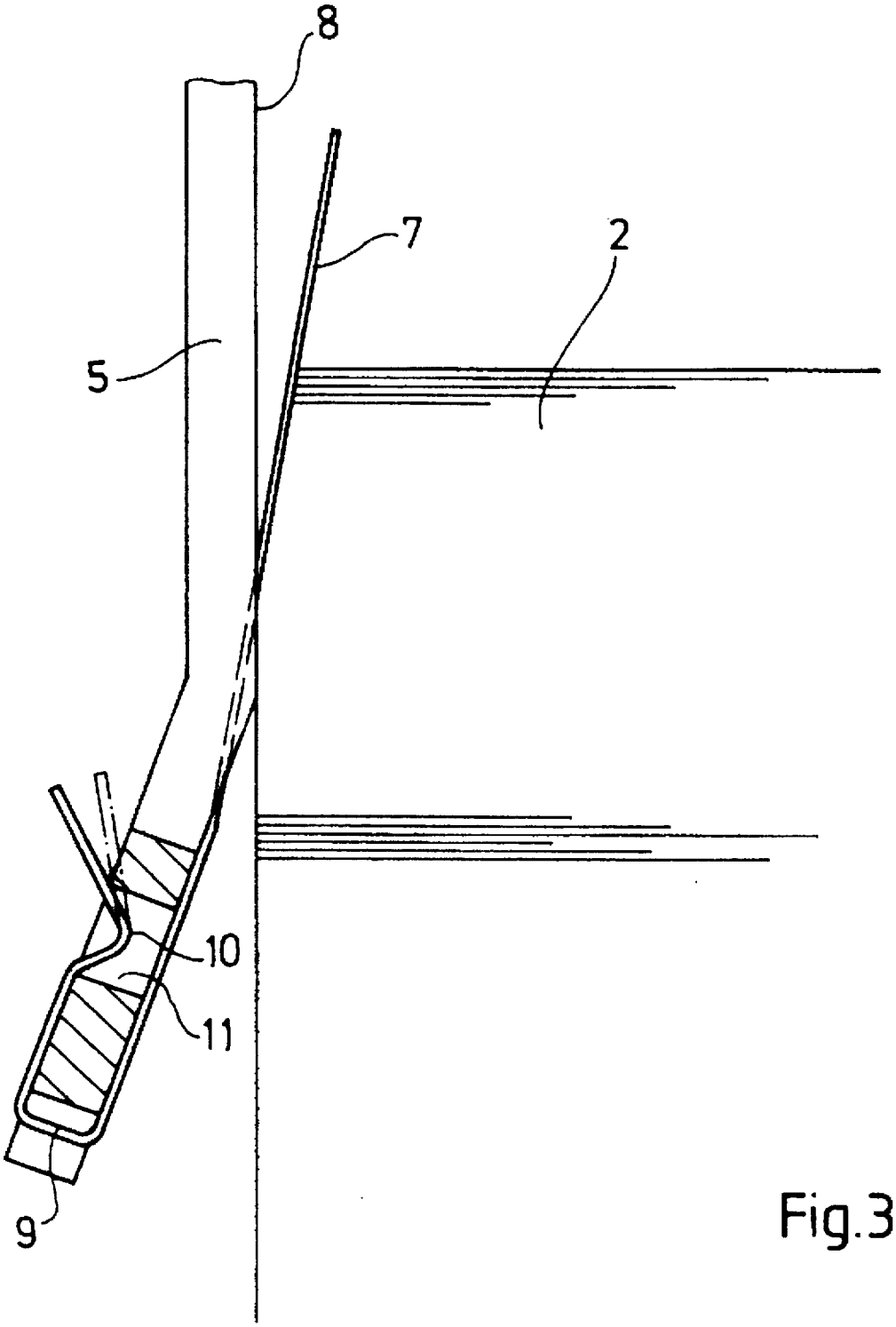
FIG. 3 is an enlarged fragmentary view of FIG. 2 showing the sheet guide at the left-hand side of the latter figure in greater detail.

As shown more clearly in FIGS. 2 and 3, guide plates 5 and 6 are provided for laterally guiding the upper sheets in the sheet pile. The guide plates 5 and 6 are arranged so that the sheet-guiding surface thereof extends parallel to the longitudinal middle or axial plane of the sheet-fed printing press and transversely to the feeding direction of the sheet, in order to be able to perform a size or format adjustment.

The lateral or side alignment of the sheet takes place at one lateral edge thereof in a conventional manner. At the side opposite to this aligned lateral edge, a deformable leaf spring 7 is disposed at the guide plate 5 and acts by spring force against the uppermost sheets in the sheet pile 2 transversely to the sheet-feeding direction of the uppermost sheet in the sheet pile 2. On the other hand, the leaf spring 7 is re-deformable counter to the spring force to behind the surface 8 effective for the sheet guidance, so that the sheet pile 2 can be lifted unhindered between the guide plates 5 and 6. The surface 8 of the guide plate 5 has recesses 12 for receiving the leaf spring 7 when the leaf spring 7 is redeformed counter to the spring force. Therefore, the leaf spring 7 can reside in the recess 12, behind the surface 8, to assist in the removal of the sheet pile. In the alternative, the leaf spring 7 can reside next to the side of the guide plate 5. Therefore, the leaf spring 7 can be redeformed behind a plane of the surface 8 to assist in the removal of the sheet pile. The leaf spring 7 is fastened by the lower end thereof to the outwardly bent lower end of the guide plate 5 and has, in addition, a U-shaped, pocket-type construction 9 with a clamping nose or beak 10 which engages in a catch 11, for example, a bore formed in the guide plate 5. To exchange or replace the leaf spring 7, the clamping nose 10 is lifted out of the catch 11, so that the leaf spring 7 can be withdrawn downwardly from the lower edge of the guide plate 5. The assembly of the leaf spring 7 takes place conversely, so that a quick change is possible for adjusting to various different characteristics or properties of the printed paper or the like. So that the leaf spring 7 can yield back counter to the spring force to behind the surface 8 of the guide plate 5, the leaf spring 7 is disposed, for example, in the vicinity of a recess formed in the surface 8 of the guide plate 5 or laterally near a guide plate as clearly illustrated in FIG. 1. Mutually adjacent catches 11 spaced-apart in a row in the sheet-feeding direction can be provided on the guide plate 5 for adjusting to varying sheet sizes or formats, the leaf spring 7 being then slidable to the advantageous location on the guide plate 5 in order to adjust to the appropriate sheet format. Alternatively, an adjustable arrangement of the leaf spring 7 in the sheet-feeding direction or several leaf springs 7 adjacent one another in the sheet-feeding direction is possible, so that at least one leaf spring 7 is effective for varying sheet formats. Sheet springs formed of steel with varying thickness are preferred for varying paper qualities, however, leaf springs formed of other materials are also suitable.

The foregoing is a description corresponding in substance to German Application P 44 31 488.4, dated Sep. 3, 1994, the International priority of which is being claimed for the instant application, and which is hereby made part of this application. Any material discrepancies between the foregoing specification and the aforementioned corresponding German application are to be resolved in favor of the latter.

We claim:

1. In a feeder of a sheet-fed printing press, a sheet guide comprising:

lateral guide plates for upper sheets of a sheet pile for laterally aligning the upper sheets with one sheet edge, one of said lateral guide plates having a lower end and at least one recess formed therein;

at least one deformable leaf spring located at a side of the sheet pile opposite to the side thereof at which the aligned sheet edge is disposed and acting by spring force against the upper sheets transversely to a sheet-feeding direction of the upper sheets of the sheet pile;

said leaf spring being re-deformable counter to said spring force and residing in said at least one recess of said one of said guide plates;

said leaf spring extending from below and from the outside of said one of said guide plates in an inclined upward and inward direction; and said leaf spring a lower fastening being formed with a clamping nose slidable with spring bias on said lower end of said one of said guide plates.

2. Sheet guide according to claim 1, wherein said fastening end of said leaf spring has a U-shaped construction, and said clamping nose engages in a catch disposed on said guide plate.

3. Sheet guide according to claim 1, wherein said leaf spring is disposed so as to be adjustable in a sheet-feeding direction of the uppermost sheet of the sheet pile.

4. Sheet guide according to claim 1, including a plurality of said leaf springs disposed adjacent one another at one side of the sheet pile in a sheet-feeding direction of the uppermost sheet of the sheet pile.

5. Sheet guide according to claim 1, including a plurality of said leaf springs having varying spring tension, said leaf springs, respectively, being exchangeable for one another.

6. In a feeder of a sheet-fed printing press, a sheet guide, comprising:

lateral guide plates for upper sheets of a sheet pile for laterally aligning the upper sheets with one sheet edge, one of said lateral guide plates having a lower end, a surface, and a side;

at least one deformable leaf spring located at said side of said one of said guide plates opposite to the side thereof at which the aligned sheet edge is disposed and acting by spring force against the upper sheets transversely to a sheet-feeding direction of the upper sheets of the sheet pile;

said leaf spring being re-deformable counter to said spring force and residing at said side of said one of said guide plates behind said surface of said one of said leaf s plates;

said leaf spring extending from below and from the outside of said one of said guide plates in an inclined upward and inward direction; and said leaf spring having a lower fastening end being formed with a clamping nose slidable with spring bias on said lower end of said one of said guide plates.

* * * * *